United States Patent [19]

Biddle

[11] 4,403,530

[45] Sep. 13, 1983

[54] TORQUE WRENCH

[75] Inventor: Howard W. Biddle, Cambridge, England

[73] Assignee: Cambridge Consultants Limited, Cambridge, England

[21] Appl. No.: 224,032

[22] Filed: Jan. 12, 1981

[30] Foreign Application Priority Data

Jan. 11, 1980 [GB] United Kingdom ..... 8001025

[51] Int. Cl.[3] ..... B25B 23/142

[52] U.S. Cl. ..... 81/478

[58] Field of Search ..... 81/478, 483, 467–477; 73/862.53, 862.22, 862.23

[56] References Cited

U.S. PATENT DOCUMENTS

| | | | |
|---|---|---|---|
| 1,733,642 | 10/1929 | Beduorz | 81/478 |
| 2,749,786 | 6/1956 | Ollagnon | 81/477 |
| 3,308,690 | 3/1967 | LaPointe | 81/478 |

FOREIGN PATENT DOCUMENTS

| | | | |
|---|---|---|---|
| 32488 | 7/1981 | European Pat. Off. | 81/478 |
| 2259097 | 12/1972 | Fed. Rep. of Germany | 81/483 |
| 2397920 | 2/1979 | France . | |
| 480516 | 2/1938 | United Kingdom | 81/478 |
| 575426 | 2/1946 | United Kingdom | 81/483 |
| 1535552 | 12/1978 | United Kingdom . | |
| 712242 | 11/1980 | U.S.S.R. | 81/478 |

*Primary Examiner*—James L. Jones, Jr.

*Attorney, Agent, or Firm*—Hopgood, Calimafde, Kalil, Blaustein & Judlowe

[57] ABSTRACT

A torque wrench comprising a driving head, an operating arm and an adjustable torque limit signalling means characterized by:

a first arm drivingly connected with the driving head, a second arm pivotally coupled to the driving head, a torque limit signalling assembly slidably adjustable in position along one of the arms for selecting a torque limit, the assembly including a non-linear spring means arranged to transmit force between the arms and to signal the occurrence of an abrupt change in spring force in accordance with the selected limit. Preferably the non-linear spring is constituted by a disc washer, and one of the arms is calibrated.

12 Claims, 5 Drawing Figures

TORQUE WRENCH

Figure 1:
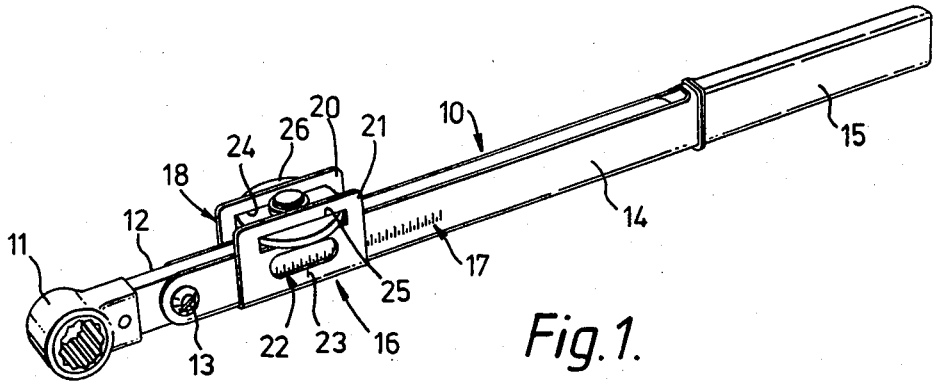

The present invention relates to a torque wrench.

Torque wrenches may be of the direct reading or preset types. The direct reading type incorporates an indicating means. In this case the force applied to the wrench is increased until a pointer of the indicating means shows a selected torque value. This has the disadvantage that skill is required to achieve the indicated force and the operator must have good vision of the indicating means. The preset type is sometimes called a "broken-back" type. This type is characterised by a driving head, an operating arm connected to the driving head, and an adjustable torque limit signalling means by which the operator knows immediately the torque limit has been reached. A typical wrench comprises a spring member and a cam having a steep gradient portion, followed by a shallower portion. As force is applied in increasing amounts, the spring member is forced up the steep portion until the shallow portion is reached, when the draw force suddenly falls and a click is felt. The wrench resets itself automatically when force is released. The applied torque may be adjusted by varying the spring preload e.g. by means of a screw member to which is attached a calibrated scale.

Wrenches comprising cams and springs are expensive to produce, requiring specially formed parts including a hollow housing and a screw calibration mechanism.

British Pat. No. 1,535,552 describes a torque limit warning attachment which can be mounted on a conventional wrench for indicating a torque limit. The device is slidable along the handle and force is applied by the operator directly to the slidable attachment. The warning assembly of U.S. Pat. No. 1,535,552 may comprise a combination of non-linear springs which may consist of disc washers alone or in combination with a leaf spring. The device may be preloaded by means of a screw attachment which incorporates a calibrated scale and in practice the wrench itself must be calibrated before use since the moment applied will depend upon the preloading and the distance of the slidable unit from the driving head. In practice such a devices are cumbersome to use, involving two calibration scales and having a constraint upon the handling position of the wrench. Also the provision of the springs within a tubular container with a screw setting means that they are expensive to produce.

The present invention is aimed at the production of a simple and efficient torque wrench of the broken-back type.

According to the invention there is provided a torque wrench comprising a driving head, an operating arm and an adjustable torque limit signalling means characterised by:

- a first arm drivingly connected with the driving head,
- a second arm pivotally coupled to the driving head,
- a torque limit signalling assembly slidably adjustable in position along one of the arms, which arm may have a lengthwise calibration scale,
- the assembly including a non-linear spring means arranged to transmit a force having a constant limit value between the arms and to signal the occurrence of such force limit value by an abrupt change in spring force in accordance with the torque limit selected e.g. on the scale.

The force transmission between the arms may in general be by pressure or by tension but in the preferred case the second arm comprises a handle at one end and is pivotally coupled at the other end to the first arm, the second arm being calibrated, so that the transmission is by pressure from the second arm to the first arm. The non-linear spring may be conveniently positioned between the arms. An alternative arrangement would be for the second arm to be journally coupled directly to the head by means of a bush or bearing.

The second arm may comprise a longitudinal recess e.g. by forming the second arm of U-section, and the first arm may be housed at least partially within the recess to comprise a compact unit.

The non-linear spring may be a known device in which the spring action is regressive after a peak has been reached. A common form of non-linear spring has a bi-stable characteristic which operates similarly to a toggle mechanism. In the present case, however, after the necessary torque has been applied and force is released, it is necessary for the wrench to revert to its original operating position. To avoid the need for a return spring it is preferred to use a mono-stable spring with a regressive characteristic.

The preferred spring is constituted by a single disc washer, sometimes called a Belleville washer, having a central bore and concave and convex faces. If desired a plurality of such washers may be used, arranged back to back. It has been found possible to employ standard manufactured wahsers provided that they are tested and washers falling outside the required degree of tolerance are rejected. Such washers fall under DIN standard 2093.

Alternative forms of non-linear springs having a mono-stable regressive characteristic would include a steel strip having a bowed cross-section, which can snap over about a width-wise axis, or a leaf spring which is stopped at both ends and is prevented from assuming a second stable position.

In the preferred embodiment the carriage is of U-section having a web and two limbs and extends around the second arm, with limbs extending over the first arm, the limbs having opposed slots, the assembly including a load member having a bore and extending over the first member with one portion thereof received in the slots, a plunger extending through the bore and having a flanged head engaging the second arm, the disc washer being housed between the load member and the first arm with the plunger extending through the bore of the washer, the convex surface of the disc washer facing the first arm and being retained by the plunger flange.

Preferably means are provided for holding the carriage at a predetermined position on the second arm. This may be constituted by forming a carriage so that it grips the second arm and is spring loaded against it.

Preferably means are provided for pre-loading the disc washer or other non-linear spring to extend its life.

Figure 2:
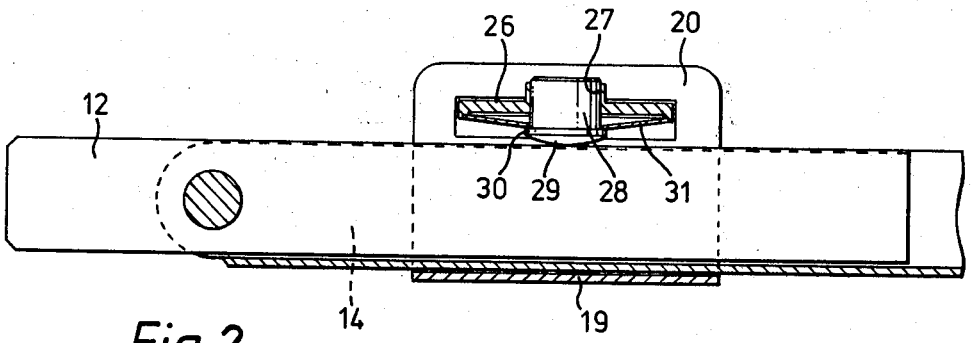
Figure 3:
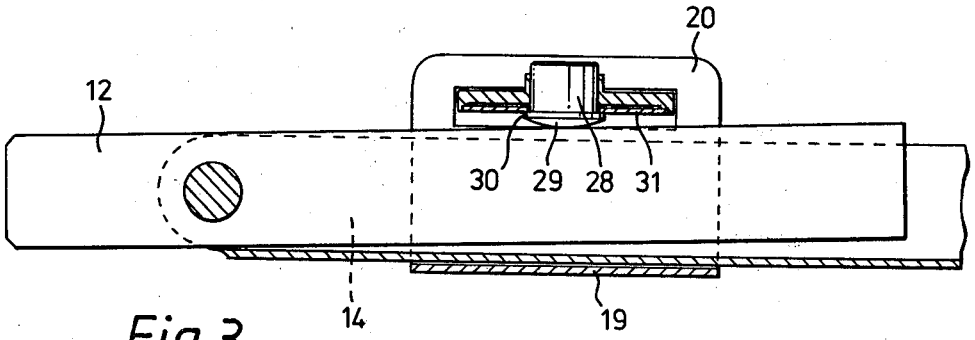
Figure 4:
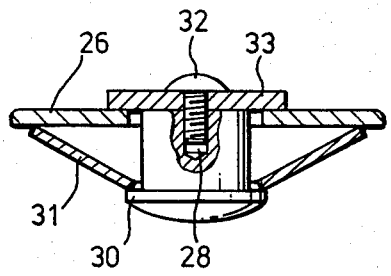
Figure 5:
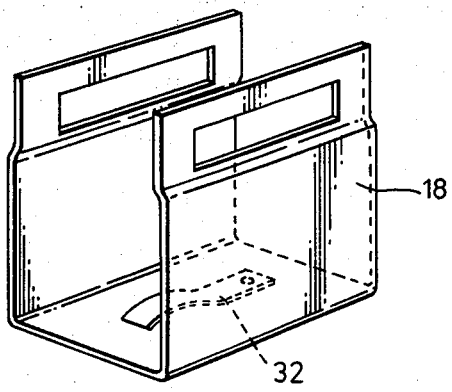

An embodiment of the invention is hereafter described with reference to the accompanying drawings in which:

FIG. 1 is a perspective view of a torque wrench in accordance with the invention, FIG. 2 and FIG. 3 are longitudinal cross-sectional views showing the position of the spring at rest and in the snapped through position, FIG. 4 is a cross-sectional view through a preloaded disc washer, and FIG. 5 is a perspective view illustrating alternative forms of holding means for the carriage.

In the drawings there is shown a torque wrench 10 having a driving head 11 rigidly mounted to a first arm 12. The first arm 12 is pivotally connected at 13 to a second arm 14, which is in effect an operating arm and which is provided with a handle 15 at its free end. The operating arm 14 is of U-section and houses the arm 12.

A torque limit signalling assembly 16 is slidable along the arm 14 which is calibrated as shown at 17.

The assembly 16 comprises a U-sectioned carriage 18 the web 19 of which underlies the arm 14 and the two limbs 20 and 21 of which extend over the first arm 12. The carriage 18 has a calibration slot 22 and pointer 23 by which its position can be adjusted in relation to the calibration scale 17 on the arm 14.

The carriage also has opposed slots 24,25 in the respective limbs 20,21 over the arm 12 within which are received end portions of a load washer 26. As shown more clearly in FIGS. 2 and 3, the load washer is formed with a central bore 27 through which is located a plunger 28 which is formed on the interior side with a convex head 29 and flange 30. The convex head 29 engages the top of the first arm 12 at an adjustable position which is indicated by the pointer 23 in relation to the calibrated scale 17.

A disc washer 31 is pierced by the plunger 28 and retained between the load washer 26 and the first arm 12 by the flange 30. In FIGS. 1 to 3 it is shown held in an unstressed condition, but it is preferred to preload the disc washer as shown in FIG. 4 by providing a rivet head or bolt 32 at the end of the plunger 28, by means of which the disc washer 31 can be clamped in a stressed condition between the flange 30 and a retaining washer 33. This provides for a longer fatigue life in the disc washer 31.

A typical suitable disc washer has an outer diameter of 34 mm, and internal diameter of 12.2 mm, a thickness of 0.8 mm and a conical height of 0.25 mm. This will give a snap action typically at a force of approximately 680 N.

FIG. 5 shows two alternative means for providing that the carrier 18 is held at the selected position on the arm 14. The upper ends of the limbs of the carrier 18 can be pinched as shown so that there is sufficient spring action in the U-member to grip the arm 14. Alternatively as shown in broken lines, a jockey spring 32 may be provided to clamp the carriage against the arm 18. If desired a clamping bolt could be provided, or a magnet.

The scale 17 is virtually linear. It is theoretically linear if the two arms extend from the head 11 and it is desirable to make the pivot point 13 as close to the head 11 as possible. The scale would in practice be calibrated emperically from a prototype in foot pounds or equivalent measures. Provided the disc washers are made to the required degree of tolerance, no alteration in calibration is needed between one and another.

In use, the operator moves the carrier 18 along the scale 17 to the desired torque force and then applies the tool, the handle being pressed downwards in the position shown in FIG. 1, until the disc washer snaps through to the position of FIG. 3 which will result in a sharp audible click. At the same time the handle will move freely through a certain angle which will indicate to the operator that the peak force has been reached.

It will be apparent that by means of the invention a simple and efficient but economically advantageous torque wrench is produced, with a small number of manufactured parts, the critical part, the disc washer, being commercially available.

The first arm may if desired be connected to the driving head by a ratchet mechanism. Also, the carriage and second arm may be provided with notched rest positions. A calibration scale is not absolutely necessary since the wrench may be set prior to use on a torque setting jig. It will be appreciated that the force transmitted by the disc washer or equivalent spring means has a constant limit, its position along the arm determining the moment at which such force limit comes into operation.

I claim:

1. A torque wrench comprising a driving head, an operating arm and an adjustable torque limit signalling means characterized by: a first arm drivingly connected with the driving head, a second arm pivotally coupled to the driving head, a torque limit signalling assembly slidably adjustable in position along one of the arms for selecting a torque limit, said assembly including a non-linear spring having a spring limit at a single fixed compressional force unique to said spring, said spring being arranged to apply force in reaction to pivoted displacement of said arms with respect to each other at the adjusted position of said assembly and to at least the extent of said fixed force; whereby, upon attainment of said spring limit, namely, a predetermined fixed force regardless of assembly position, the setting of the torque wrench is solely a function of selected positioning of said assembly along said one arm.

2. A torque wrench according to claim 1 wherein the second arm comprises a handle at one end and is pivotally coupled at the other end to the first arm, one arm being calibrated.

3. A torque wrench according to claim 2 wherein the second arm comprises a longitudinal recess within which the first arm is housed.

4. A torque wrench according to claim 3 wherein the second arm is of U-section.

5. A torque wrench according to claim 1 wherein the spring comprises a disc washer having a central bore and concave and convex faces.

6. A torque wrench according to claim 1 wherein the spring means has a regressive characteristic, the abrupt change in force being a peak force.

7. A torque wrench comprising a driving head, an operating arm and an adjustable torque limit signalling means characterized by a first arm drivingly connected with the driving head, a second arm pivotally coupled to the driving head, a torque-limit-signalling assembly including a carriage slidably adjustable in position along one of the arms for selecting a torque limit, said assembly including a non-linear spring means comprising a disc washer having a central bore and concave and convex surfaces and arranged to transmit a force having a constant limit value between the arms and to signal the occurrence of such force limit value by an abrupt change in spring force in accordance with the selected torque limit, said carriage being of U-section having a web and two limbs and extending over the first arm, the limbs having opposed slots, said assembly further including a load member having a bore and extending over the first arm with one portion thereof received in the slots, a plunger extending through the bore and having a flanged head engaging the second arm, the disc washer being housed between the load member and the first arm with the plunger extending through the bore of the washer, and the convex surface of the disc washer facing the first arm and being retained by the plunger flange.

8. A torque wrench according to claim 7 including means for holding the carriage at a predetermined position on the second arm.

9. A torque wrench according to claim 7 including means for preloading the disc washer.

10. A torque wrench according to claim 8 wherein the preloading means includes means coupling the plunger to the load member.

11. A torque wrench comprising a driving head, an operating arm and an adjustable torque-limit-signalling means characterized by a first arm drivingly connected with the driving head, a second arm pivotally coupled to the driving head, a torque-limit-signalling assembly including a carriage slidably adjustable in position along one of the arms for selecting a torque limit, said assembly including a non-linear spring comprising a disc washer having a central bore and concave and convex surfaces and arranged to transmit a force having a constant limit value between the arms to signal the occurrence of such force limit value by an abrupt change in spring force in accordance with the selected torque limit, said carriage having a web and two limbs and extending around the second arm with the limbs extending over the first arm and being formed with receiving means, said assembly further including a load member having a bore and extending over the first arm and retained by said receiving means, a plunger extending through the bore and having a head engaging the second arm, the disc washer being between the load member and the first arm with the plunger extending through the bore of the washer, and the convex surface of the disc washer facing the first arm and being retained by the head of the plunger.

12. A torque wrench comprising a driving head, an operating arm and an adjustable torque-limit signalling means, characterized by a first arm drivingly connected with the driving head, a second arm adapted for manual grasp at one end and pivotally coupled at its other end to the driving head, and a torque-limit-signalling assembly slidably adjustable in position along said arms for selecting a torque limit, said assembly including frame structure rigidly surrounding both said arms in near-lapped relation and establishing between frame-limited ends a range of pivoted lost-motion articulation of said arms with respect to each other, said frame structure having contact with one arm at one of said ends and being near but spaced from the other arm at the other of said ends, and means including a disc washer retained by said frame structure and compressionally reacting within said space and between said other arm and adjacent frame structure, the extent of lost motion being sufficient to operate said disc washer at least to its spring limit, the spring limit is a single fixed compressional force unique to said disc washer, the torque limit of said wrench is selectively adjustable solely in accordance with the extent of slidable adjustment along said arms.

* * * * *